US012324946B1

(12) United States Patent
Yu

(10) Patent No.: US 12,324,946 B1
(45) Date of Patent: Jun. 10, 2025

(54) FAST ADJUSTABLE DUMBBELL

(71) Applicant: Zhejiang Zuojian Industry and Trade Co., Ltd., Jinhua (CN)

(72) Inventor: Zhaohong Yu, Yongkang (CN)

(73) Assignee: Zhejiang Zuojian Industry and Trade Co., Ltd., Jinhua (CN)

( * ) Notice: Subject to any disclaimer, the term of this patent is extended or adjusted under 35 U.S.C. 154(b) by 0 days.

(21) Appl. No.: 18/963,849

(22) Filed: Nov. 29, 2024

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/075; A63B 21/0726
See application file for complete search history.

(56) References Cited

U.S. PATENT DOCUMENTS

D1,058,725 S * 1/2025 Yu ..... D21/681
12,214,239 B1 * 2/2025 Yu ..... A63B 21/0726
2009/0305852 A1 * 12/2009 Hoglund ..... A63B 21/075 482/107
2013/0324375 A1 * 12/2013 Svenberg ..... A63B 21/00069 482/108
2020/0376320 A1 * 12/2020 Wang ..... A63B 21/0726
2021/0146186 A1 * 5/2021 Chen ..... A63B 21/075
2022/0193479 A1 * 6/2022 Wu ..... A63B 21/075
2022/0193481 A1 * 6/2022 Wu ..... A63B 21/0728
2023/0001258 A1 * 1/2023 Svenberg ..... A63B 21/075
2023/0173328 A1 * 6/2023 Wu ..... A63B 21/075 482/107
2023/0271050 A1 * 8/2023 Tong ..... A63B 21/0728 482/108
2023/0347200 A1 * 11/2023 Casagrande ..... A63B 21/075
2024/0198166 A1 * 6/2024 Wang ..... A63B 21/075

FOREIGN PATENT DOCUMENTS

CN 204380076 U * 6/2015
DE 202024103165 U1 * 8/2024

* cited by examiner

*Primary Examiner* — Joshua T Kennedy
(74) *Attorney, Agent, or Firm* — JEEN IP LAW, LLC

(57) ABSTRACT

A fast adjustable dumbbell is provided, which includes a handle provided with a first accommodation cavity; a plurality of dumbbell pieces, two groups of dumbbell pieces are respectively provided at outer sides of two ends of the handle, and the dumbbell pieces are provided with first through holes; a rotatable shaft including two independent half shafts, which are provided in the first accommodation cavity, the two half shafts can move relative to the handle, and outer surfaces of the two half shafts are provided with symmetrical first threads; two transmission components respectively fixed at the two ends of the handle, and the transmission components are provided with second through holes corresponding to the first accommodation cavity. Hole walls of the second through holes are provided with second threads that are engaged with the half shafts; when the handle is rotated, the two transmission components are driven to rotate.

8 Claims, 8 Drawing Sheets

FAST ADJUSTABLE DUMBBELL

TECHNICAL FIELD

The present disclosure relates to the field of fitness equipment technologies, and in particular, to a fast adjustable dumbbell.

BACKGROUND

Dumbbells include an integrated dumbbell and an assembled dumbbell. The assembled dumbbell has a small volume and adjustable weight, which is more suitable for daily muscle strength exercise equipment at home. At present, traditional assembled dumbbells have dumbbell handles and dumbbell pieces. By adjusting the number of bell pieces on the dumbbell handle, the weight of the dumbbell can be adjusted to switch training intensity. However, when replacing the dumbbell pieces with the regular dumbbells, it is necessary to replace fixing parts at two ends before removing or installing the dumbbell pieces, this is a very complicated process.

SUMMARY

Based on this, it is necessary to provide a fast adjustable dumbbell that can quickly select a required number of dumbbells and improve efficiency to address the aforementioned technical issues.

In a first aspect, the present application provides a quick adjustable dumbbell which includes:

a handle, provided with a first accommodation cavity;

a plurality of dumbbell pieces, the dumbbell pieces are divided into two groups, and the two groups of dumbbell pieces are respectively provided on outer sides of two ends of the handle, and each of the dumbbell pieces is provided with a first through hole;

a rotatable shaft, including two independent half shafts, the two half shafts are provided in the first accommodation cavity, and the two half shafts are capable of being moved relative to the handle; outer surfaces of the two half shafts are provided with symmetrical first threads, and positions of the two half shafts are aligned with the first through holes;

two transmission components, which are respectively fixed at the two ends of the handle, and the two transmission components are provided with second through holes corresponding to a position of the first accommodation cavity; hole walls of the second through holes are provided with second threads that are engaged with the half shafts;

when the handle is rotated, the two transmission components are driven to rotate, and the two half shafts that are engaged with the transmission components are compressed and extended from the second through holes to pass through the first through holes of the dumbbell pieces when the transmission components are rotated.

In one embodiment, the handle includes a handheld part and a fixing part; there are two fixing parts, and the two fixing parts are respectively provided at two ends of the handheld part; the dumbbell further includes two first fixing members, which are respectively fixed with the fixing part and the transmission components.

In one embodiment, the fixing part is provided with a first positioning hole;

each of the two first fixing members includes a first positioning part and a second positioning part, where each of the two first fixing members is sleeved on the fixing part and the first positioning part is clamped into the first positioning hole;

each of the two transmission components is provided with a second positioning hole, and each of the two transmission components is provided at one side of one first fixing member away from the handheld part, and the second positioning part is clamped into the second positioning hole.

In one embodiment, the dumbbell further includes a fixed shaft, and a second accommodation cavity is formed in the rotatable shaft configured for setting the fixed shaft.

In one embodiment, the dumbbell the dumbbell includes a base, a second fixing member, and a pin, the handle further includes a sliding part, which is provided between the fixing part and the handheld part;

the base is provided on the sliding part;

the second fixing member is provided on one side of one transmission component away from one first fixing member, and is fixed to the base at an outside of one transmission component to clamp the transmission component between the base and the second fixing member; the second fixing member is provided with an insertion hole;

one end of the fixed shaft is exposed from the first accommodation cavity and is provided with a slot, the slot is aligned with the insertion hole;

the plug is inserted into the insertion hole and the slot so as to fix the fixed shaft to the second fixing member.

In one embodiment, the dumbbell further includes a bearing and a nut, and the handle further includes a rotatable part located between the sliding part and the fixing part, the bearing is sleeved on the sliding part, and the base is sleeved on the bearing;

an outer surface of the rotatable part is provided with a third thread, and a screw hole of the nut is provided with a fourth thread, the nut is threaded connection to the rotatable part, so that the handle is capable of being rotated relative to the nut.

In one embodiment, the dumbbell further includes a weight scale ring, and the handle further includes a clamping part, the clamping part is located between the sliding part and the handheld part, and an outer surface of the clamping part is provided with a first notch;

an inner wall of the weight scale ring is provided with a second notch, and the weight scale ring is sleeved on the clamping part; the first notch is clamped to the second notch, so that the weight scale ring and the handle are fixed;

the base is protruded outwardly from one side of the handheld part to form a sleeve ring, and the weight scale ring is embedded in the sleeve ring; the sleeve ring is provided with a display window to display scale values on the weight scale ring.

In one embodiment, a plurality of third accommodation cavities are provided on one side of the base facing the transmission components along a circumferential direction of the base, and each of the third accommodation cavities is provided with a first elastic member and a rolling member;

one side of each one transmission component that is facing the base is provided with a plurality of rolling holes along the circumferential direction;

when the transmission components are rotated to be aligned with the rolling holes and the rolling member, the rolling member is popped out towards the rolling holes under an action of the first elastic member, and at other positions of the transmission components, the rolling member is rolled on one side of the transmission component.

In one embodiment, the dumbbell further includes a fixed seat, a locking member, and a second elastic member, the fixed seat is configured to place the dumbbell pieces and the handle, and the fixed seat is provided with a protruding lifting piece;

each of the two transmission components is provided with a plurality of spaced protrusions along the circumferential direction;

the base is provided with a fourth accommodation cavity at a position of an outer side of a corresponding transmission component; the fixing part is provided on one side of the fourth accommodation cavity close to the corresponding transmission component;

the second elastic member is provided in the second accommodation cavity, and one end of the second elastic member is fixed to the fixing part and the other end thereof is fixed to the locking member;

the locking member includes a locking part and a connection part; the connection part is provided in the fourth accommodation cavity and fixed to the other end of the second elastic member; the locking part is extended from the fourth accommodation cavity and includes a locking mouth; the protrusions are located in the locking mouth;

when the lifting member lifts the connection part, the second elastic member is compressed, and the locking part is driven to lift up; the protrusions are arranged spaced apart on two sides of the locking mouth;

when the handle is lifted, the second elastic member restores its elasticity, and the connection part pulls the locking member downwards by an elastic force, so that an upper side of the locking mouth presses the protrusions.

In one embodiment, each dumbbell piece is provided with one protrusion and one recess on two sides of the dumbbell piece, and protrusions and recesses between adjacent dumbbell pieces are clamped with each other to fix the dumbbell pieces.

The above introduces a fast adjustable dumbbell, which includes a handle, the handle is provided with a first accommodation cavity; a plurality of dumbbell pieces, divided into two groups, the two groups of dumbbell pieces are respectively provided on outer sides of two ends of the handle, and the dumbbell pieces include first through holes; a rotatable shaft, including two independent half shafts, the two half shafts are provided in the first accommodation cavity, and the two half shafts can move relative to the handle; outer surfaces of the two half shafts are provided with symmetrical first threads, and positions of the half shafts are aligned with the first through holes; two transmission components respectively fixed at the two ends of the handle, and the transmission components are provided with second through holes corresponding to a position of the first accommodation cavity; hole walls of the second through holes are provided with second threads that are engaged with the half shafts; when the handle is rotated, the two transmission components are driven to rotate, and the half shafts engaged with the transmission components is compressed and extended from the second through holes to pass through the first through holes of the dumbbell pieces when the transmission components are rotated. Therefore, when selecting dumbbells, the ratable shaft can be extended through a desired dumbbell piece by rotating the handle, which is a simple and convenient to improve the efficiency of dumbbell adjustment.

DESCRIPTION OF EMBODIMENTS

In order to render the purpose, technical solution, and advantages of the present application clearer and more understandable, the following will provide further detailed explanations of the present application in combination with the accompanying drawings and embodiments. It should be understood that the specific embodiments described herein are only used to explain the present application and are not intended to limit the present application.

Figure 1:
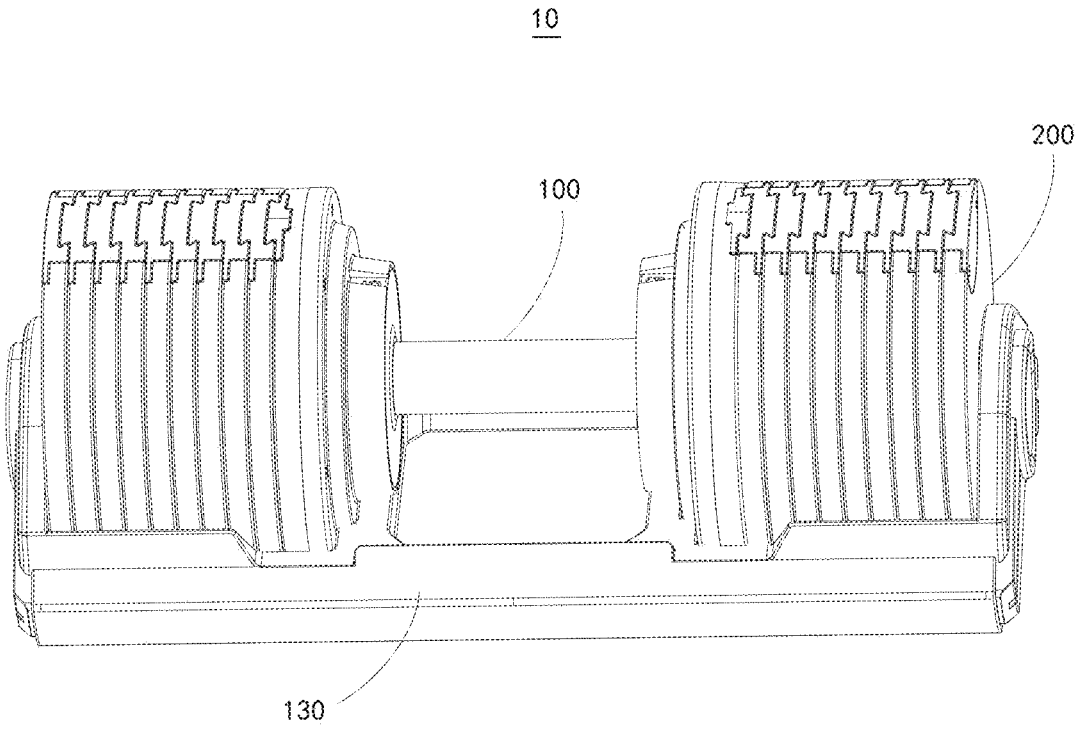
FIG. 1 is a schematic structural diagram of a fast adjustable dumbbell provided in an embodiment of the present application.
Figure 2:
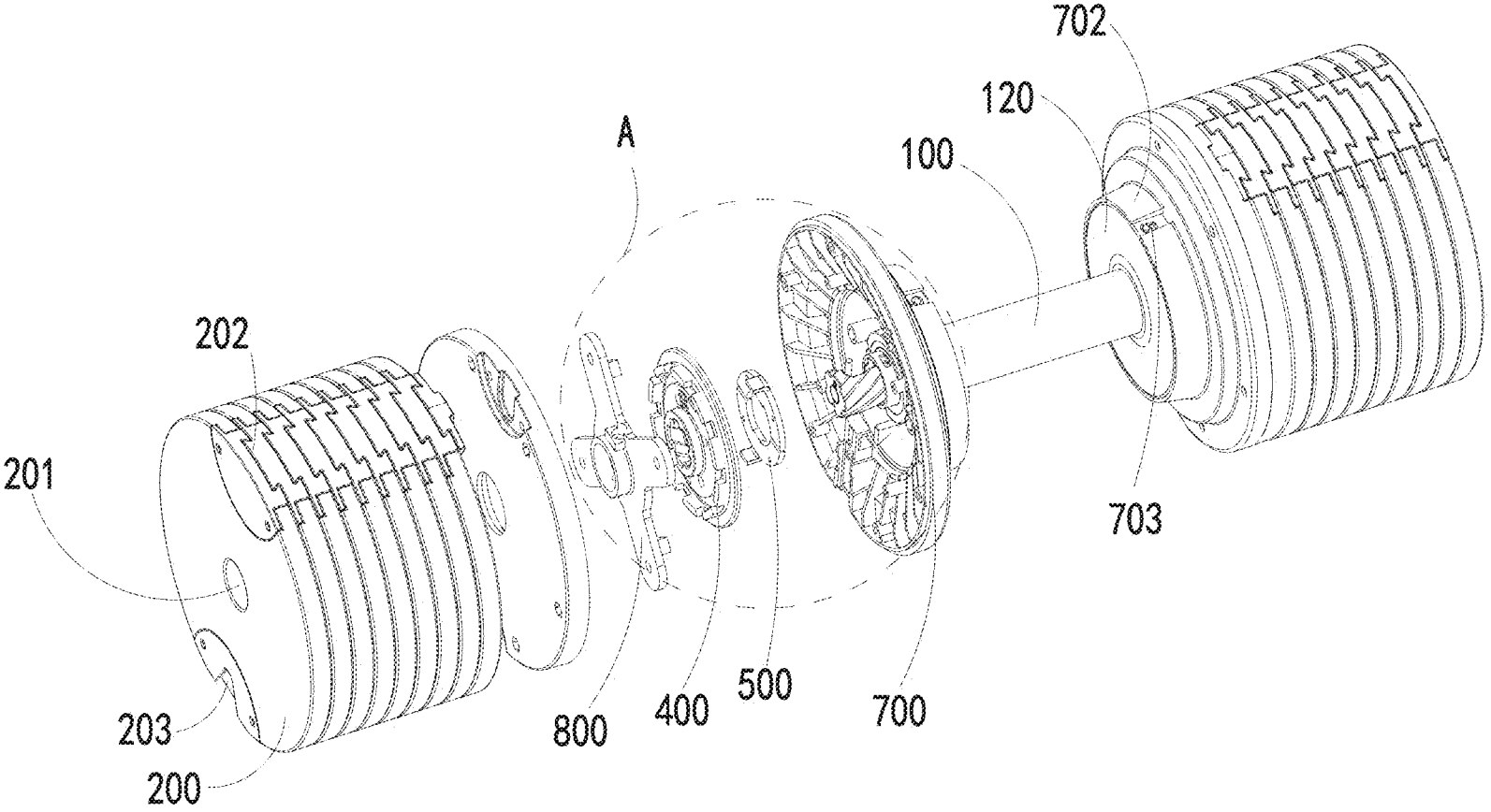
FIG. 2 is a partially exploded schematic diagram of the adjustable dumbbell shown in FIG. 1.
Figure 3:
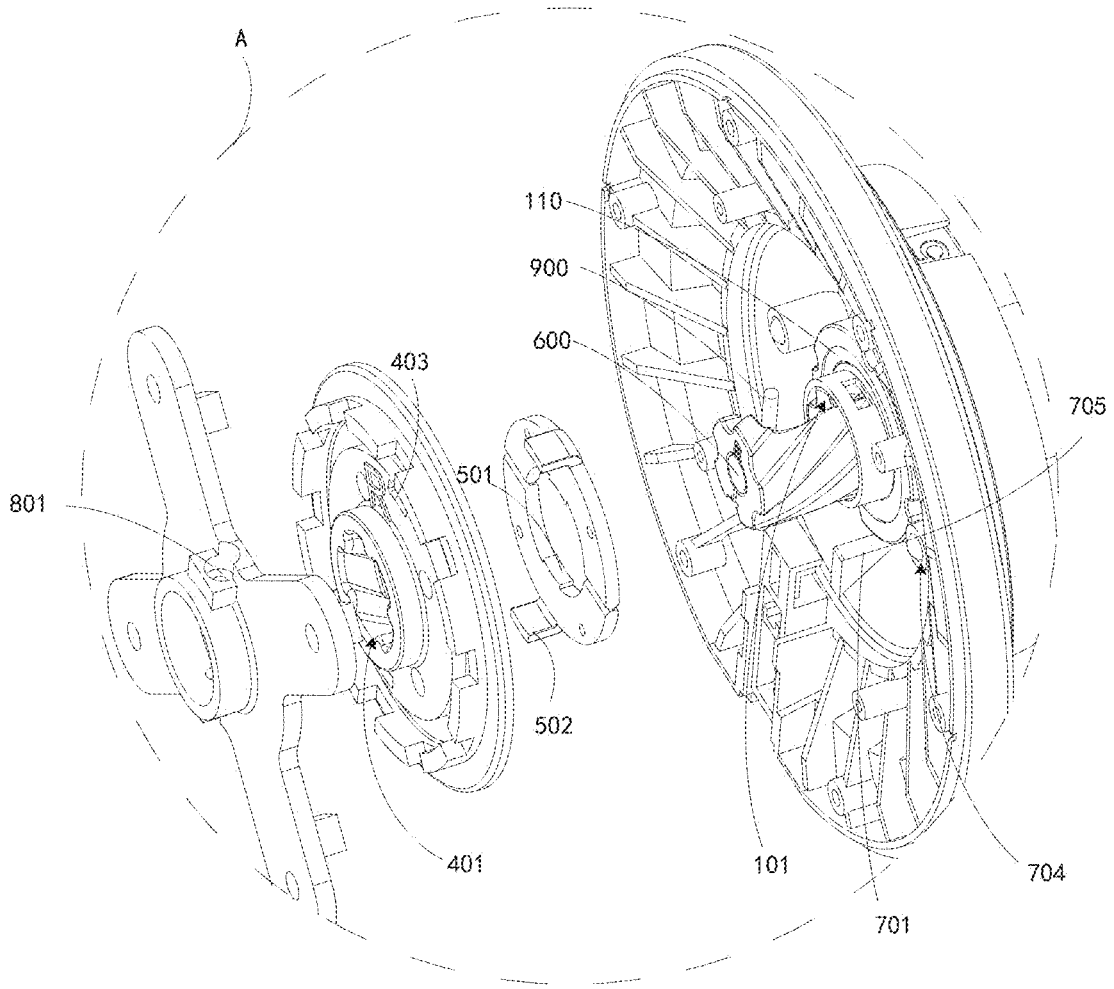
FIG. 3 is an enlarged schematic diagram of A in FIG. 2.
Figure 4:
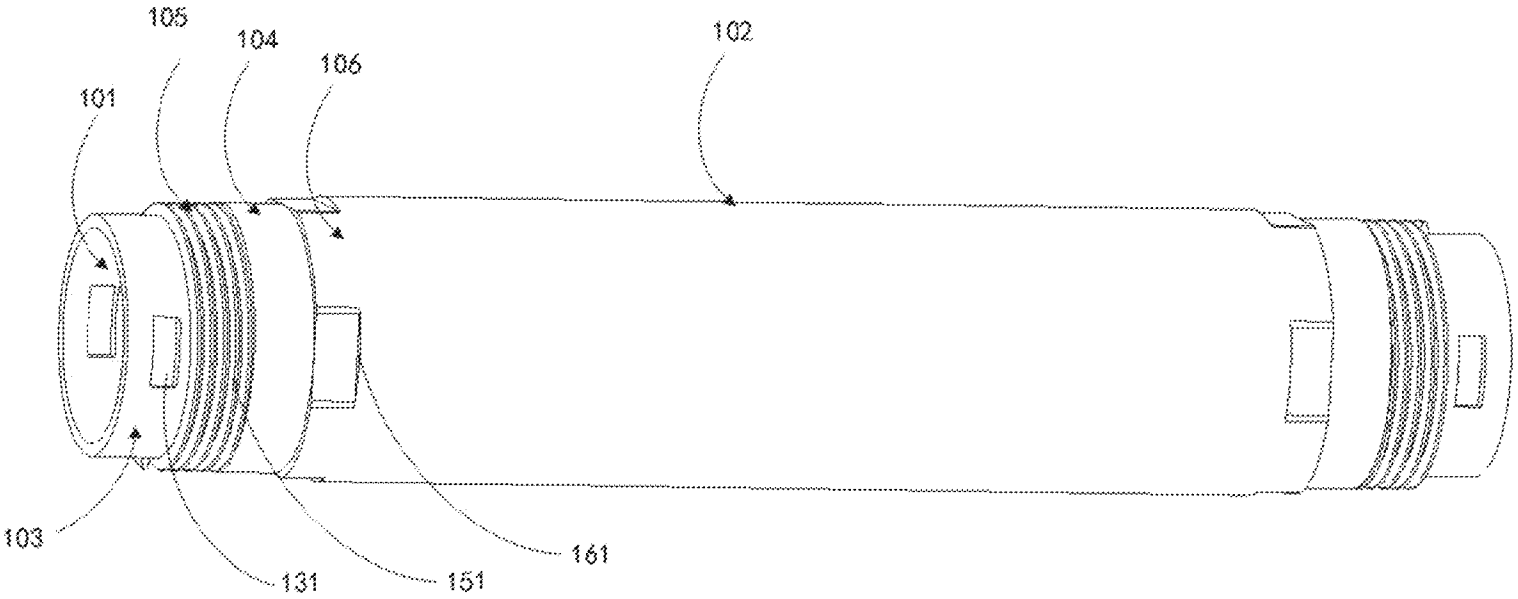
FIG. 4 is a schematic structural diagram of a handle.
Figure 5:
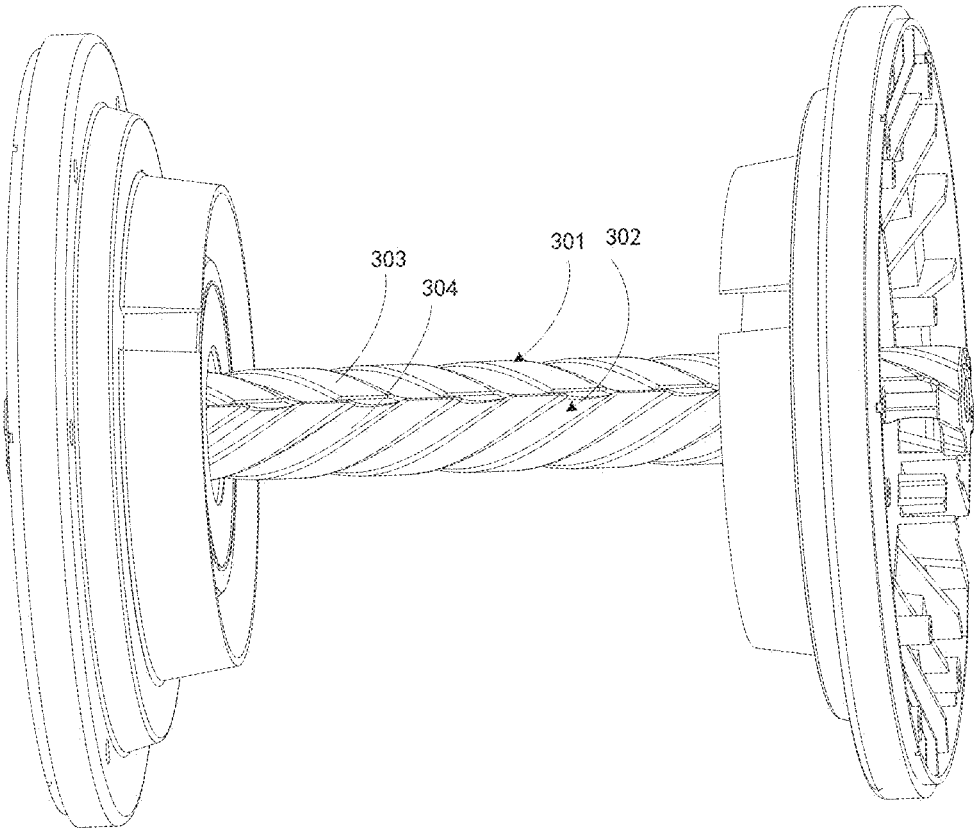
FIG. 5 is a schematic structural diagram of a rotatable shaft.
Figure 6:
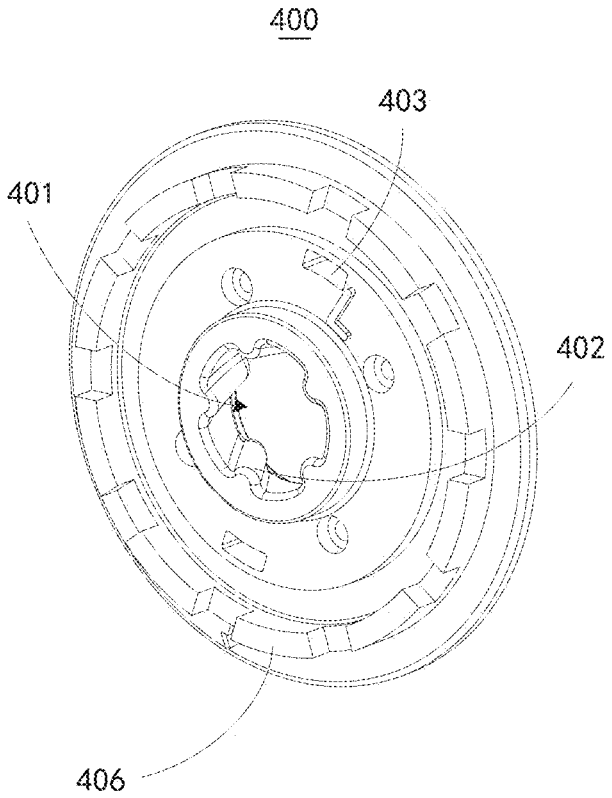
FIG. 6 is a schematic structural diagram of a transmission component from one perspective.

Please refer to FIGS. 1-6, FIG. 1 is a schematic structural diagram of a fast adjustable dumbbell provided in an embodiment of the present application. FIG. 2 is a partially exploded schematic diagram of the adjustable dumbbell shown in FIG. 1. FIG. 3 is an enlarged schematic diagram of A in FIG. 2. FIG. 4 is a schematic structural diagram of a handle. FIG. 5 is a schematic structural diagram of a rotatable shaft. FIG. 6 is a schematic structural diagram of a transmission component from one perspective. As shown in FIGS. 1-6, the dumbbell 10 includes a handle 100, a plurality of dumbbell pieces 200, a rotatable shaft 300, and a transmission component 400.

The handle 100 is provided with a first accommodation cavity 101. The handle 100 can have a cylindrical structure, rendering it convenience for a user to hold and rotate.

The plurality of dumbbell pieces 200, divided into two groups, and the two groups of dumbbell pieces 200 are respectively provided on outer sides of two ends of the handle 100, and each of the dumbbell pieces 200 is provided with a first through hole 201.

The rotatable shaft 300 includes two independent half shafts 301 and 302, which are provided in the first accommodation cavity 101 and can move relative to the handle 100. Symmetrical first threads 303 and 304 are provided on outer surfaces of the two half shafts 301 and 302, namely, the first thread 303 on the half shaft 301 and the second thread 304 on the half shaft 302 are symmetrical. Positions of the two half shafts 301 and 302 are aligned with the first through holes 201.

The two transmission components 400 are respectively fixed at the two ends of the handle 100, and each of the two transmission components 400 is provided with a second through hole 401 corresponding to a position of the first accommodation cavity 101. A hole wall of the second through hole 401 is provided with a second thread 402 that is engaged with one half shaft.

When the handle 100 is rotated, it drives the two transmission components 400 to rotate. The half shafts 301 and 302 that are engaged with the transmission components 400 are compressed and extended from the second through hole 401 to pass through the first through holes 201 of the dumbbell pieces.

Therefore, when selecting a dumbbell piece 200, it is only necessary to rotate the handle 100, that is, driving the half shafts 301 and 302 to pass through the corresponding first through holes 201 of the dumbbell pieces 200 through the transmission components 400, to complete a selection of the corresponding dumbbell piece 200, which is convenient, fast, and improves efficiency.

Please refer to FIG. 4 again, the handle 100 includes a handheld part 102 and a fixing part 103. The handheld part 102 is used for a user to hold and rotate, located in a middle position of the handle 100. There are two fixing parts 103, which are respectively located at two ends of the handheld part 102. Please refer to FIGS. 2 and 3 again. The dumbbell 10 further includes two first fixing members 500, which are respectively fixed with the fixing part 103 and the transmission components 400.

In an implementation mode, the fixing part 103 is provided with a first positioning hole 131, which can be two and symmetrically provided on two sides of the fixing part 103. The first fixing member 500 includes a first positioning part 501 and a second positioning part 502. The first fixing member 500 is sleeved on the fixing part 103, and the first positioning part 501 is clamped to the first positioning hole 131. In one embodiment, the first fixing member 500 may be a circular ring structure, and the first positioning part 501 is provided on an inner wall of the circular ring. The first positioning part 501 may be a protrusion. When the first fixing member 500 is sleeved on the fixing part 103, the protrusion is clamped to the first positioning hole 131, so that the first fixing member 500 and the handle 100 are fixed.

In an implementation mode, as shown in FIGS. 3 and 6, each of the two transmission components 400 is provided with a second positioning hole 403. The transmission component 400 is located on one side of the first fixing member 500 away from the handheld part 102, and the second positioning part 502 is clamped into the second positioning hole 403. In an implementation mode, the second positioning part 502 is extended from an outer edge of the circular ring of the first fixing member 500 towards a direction of the transmission component 400, thereby forming a protrusion. The transmission component 400 is arranged side by side with the first fixing member 500, and the second positioning part 502 is clamped into the second positioning hole 403, so that the first fixing member 500 and the transmission component 400 are fixed. Thus, by the first fixing member 500, the handle 100 and the transmission component 400 are fixed.

Please refer to FIG. 3, the dumbbell 10 further includes a fixed shaft 600, and a second accommodation cavity (not shown) is formed in the rotatable shaft 300 for setting the fixed shaft 600. Due to the fixed shaft 600 is installed in the rotatable shaft 300, when the half shafts 301 and 302 of the rotatable shaft 300 are moved outward towards the handle 100, the fixed shaft 600 can prevent the two half shafts 301 and 302 from slipping and rotating, rendering the half shafts 301 and 302 move more smoothly.

Please refer to FIGS. 2-4. The dumbbell 10 includes a base 700, a second fixing member 800, and a pin 900. Where, the handle 100 further includes a sliding part 104, which is provided between the fixing part 103 and the handheld part 102.

The base 700 is provided on the sliding part 104. The base is a circular cover structure with a through hole at its center. The handle 100 passes through the base 700, and the base 700 is located at a position of the sliding part 104.

The second fixing member 800 is provided on one side of the transmission component 400 away from the first fixing member 500 and is fixed to the base 700 at an outside of the transmission component 400 to clamp the transmission component 400 between the base 700 and the second fixing member 800. In an implementation mode, an area of the base 700 is larger than that of each one transmission component 400, and the second fixing member 800 can be a cross structure. The second fixing member 800 is fixed to the base 700 on the outside of the transmission component 400. Where, the second fixing member 800 is provided with an insertion hole 801.

Figure 8:
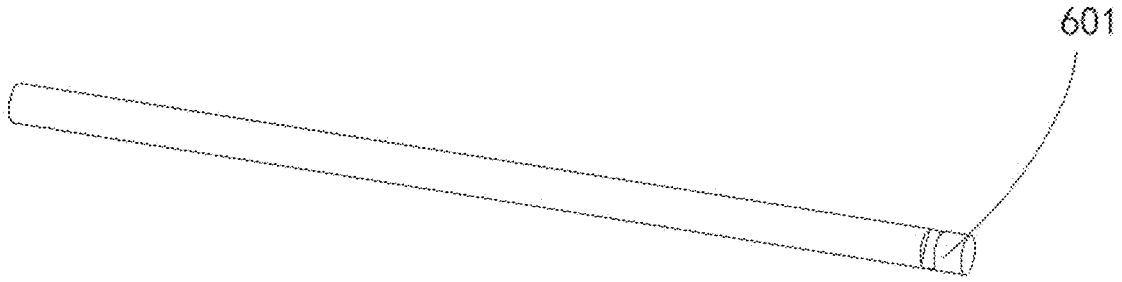
FIG. 8 is a schematic structural diagram of a fixed shaft.
Figure 9:
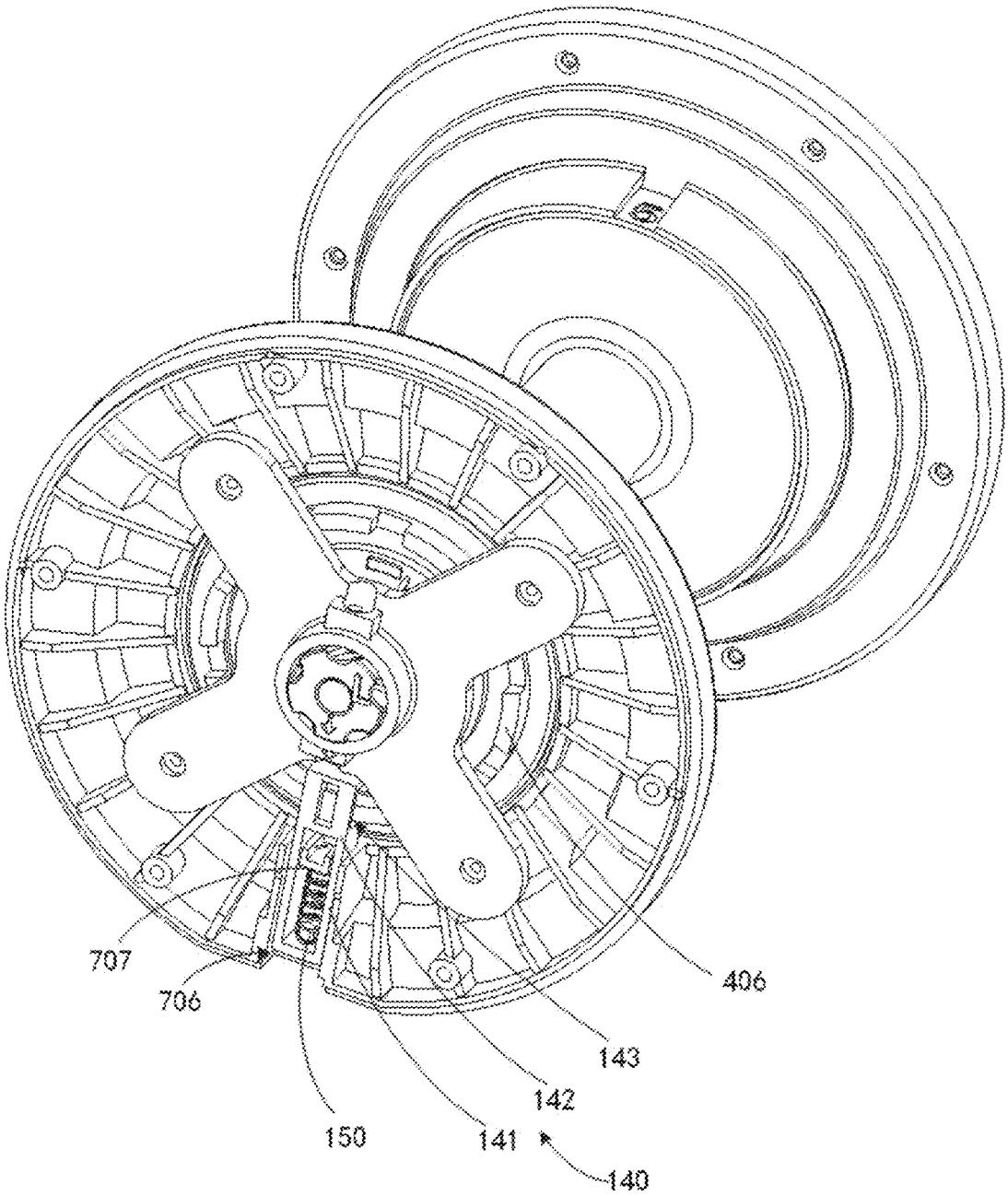
FIG. 9 is a schematic structural diagram between a fixed seat and the transmission component.

Further combining with FIG. 8, one end of the fixed shaft 600 is exposed from the first accommodation cavity 101 and is provided with a slot 601. The slot 601 is aligned with the insertion hole 801, and the pin 900 is inserted into the insertion hole 801 and the slot 601 so as to fix the fixed shaft 600 to the second fixing member 800, as shown in FIG. 9, to prevent the fixed shaft 600 from rotating with movements of the half shafts 301 and 302.

The dumbbell 10 further includes a bearing (not shown) and a nut 110, and the handle 100 includes a rotatable part 105 located between sliding part 104 and fixing part 103. The bearing is sleeved on the sliding part 104, and the base 700 is sleeved on the bearing. When the handle 100 is rotated, the bearing is stationary relative to the handle 100, so the base 700 is also stationary relative to the handle 100.

An outer surface of the rotatable part 105 is provided with a third thread 151, and a screw hole of the nut 110 is provided with a fourth thread (not show). The nut 110 is threaded connected to the rotatable part 105, so that the handle 100 can rotate relative to the nut 110. That is, when the user rotates the handheld part 102, the rotatable part 105 is rotated relative to the nut 110.

Figure 7:
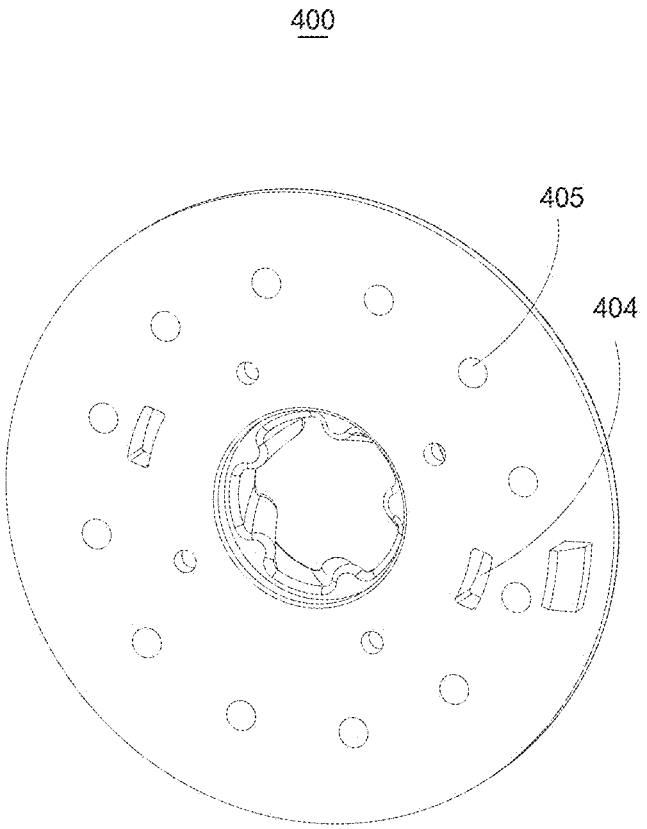
FIG. 7 is a schematic structural diagram of the transmission component from another perspective.

In an implementation mode, referring to FIGS. 3 and 7, a first positioning part 701 is provided on one side of the base 700 facing the transmission component 400, and a second positioning part 404 is provided on one side of the transmission component 400 facing the base 700. When the rotatable part 105 is rotated relative to the nut 110, the transmission component 400 follows the rotation, and the half shafts 301 and 302 will be extended. When the half shafts 301 and 302 are fully extended, the first positioning part 701 and the second positioning part 404 just abuts against, thereby preventing the half shafts 301 and 302 from being fall out of the first accommodation cavity 101.

Please refer to FIGS. 2 and 4 again. The dumbbell 10 further includes a weight scale ring 120, and the handle 100 further includes a clamping part 106. Where the clamping part 106 is located between the sliding part 104 and the handheld part 102, and an outer surface of the clamping part 106 is provided with a first notch 161, which can be multiple.

Multiple scale values are provided on an outer surface of the weight scale ring 120, which indicates the number of selected dumbbells. An inner wall of the weight scale ring 120 is provided with a second notch (not shown), and the weight scale ring 120 is sleeved on the clamping part 106. The first notch 161 is clamped to the second notch, so that the weight scale ring 120 is relatively fixed to the handle 100. The base 700 is protruded outwardly from one side of the handheld part 102 to form a sleeve ring 702, and the weight scale ring 120 is embedded in the sleeve ring 702. A display window 703 is provided on the sleeve ring 702 to display scale values on the weight scale ring 120.

On one side of the base 700 facing the transmission component 400, a plurality of third accommodation cavities 704 are provided along a circumferential direction of the base, and each of the third accommodation cavities 704 is provided with a first elastic member (not shown) and a rolling member 705.

In combination with FIG. 7, one side of each one transmission component 400 that is facing the base 700 is provided with a plurality of rolling holes 405 along the circumferential direction. When the transmission components 400 are rotated to be aligned with the rolling holes 405 and the rolling member 705, the rolling member 705 is popped out towards the rolling holes 405 under an action of the first elastic member. At other positions of the transmission components, the rolling member 705 is rolled on one side of the transmission component 400. When the transmission components 400 are rotated to be aligned with the rolling holes 405 and the rolling member 705, a sound will be emitted. It should be understood that a spacing degree between the rolling holes 405 and a spacing degree between the rolling member 705 are the same as a spacing degree set on the weight scale ring 120, that is, one scale value is displayed, and a sound is made once.

Please refer to FIGS. 1, 6, and 9 again. The dumbbell 10 further includes a fixed seat 130, a locking member 140, and a second elastic member 150. The fixed seat 130 is configured to place the dumbbell pieces 200 and the handle 100 and is provided with a protruding lifting piece (not shown). Each of the two transmission components 400 is provided with a plurality of spaced protrusions 406 along the circumferential direction. The base 700 is provided with a fourth accommodation cavity 706 at a position of an outer side of a corresponding transmission component, the fixing part 707 is provided on one side of the fourth accommodation cavity 706 close to the corresponding transmission component 400.

The second elastic member 150 is provided in the second accommodation cavity 706, and one end of the second elastic member 150 is fixed to the fixing part 707, and the other end is fixed to the locking member 140. The locking member 140 includes a locking part 142 and a connection part 141. The connection part 141 is provided in the fourth accommodation cavity 706 and fixed to the other end of the second elastic member 150. The locking part 142 is extended from the fourth accommodation cavity 706 and includes a locking mouth 143. The protrusions 406 are located in the locking mouth 143. When the dumbbell and handle 100 are placed on the fixed seat 130, the lifting member lifts the connection part 141, the second elastic member 150 is compressed, and the locking part 142 is driven to lift up. The protrusions 406 are arranged spaced apart on two sides of the locking mouth 143. At this time, the handle 100 can be rotated to select a desired dumbbell piece 200. When the handle 100 is lifted, the second elastic member 150 restores its elasticity, and the connection part 141 pulls the locking part 142 downwards by an elastic force, so that an upper side of the locking mouth 143 presses the protrusions 406, thereby completing a locking of the transmission components 400.

Please refer to FIG. 2 again. Each dumbbell piece 200 is provided with one protrusion 202 and one recess 203 on two sides of the dumbbell piece 200, protrusions and recesses between adjacent dumbbell pieces 200 are clamped with each other to fix the dumbbell pieces 200.

The various technical features of the above embodiments can be combined arbitrarily. In order to render the description concise, not all possible combinations of the various technical features in the above embodiments have been described. However, as long as there is no contradiction in the combination of these technical features, they should be considered within the scope of this specification.

The above embodiments only express several embodiments of the present application, and their descriptions are more specific and detailed, but should not be understood as limiting the scope of the present application. It should be pointed out that for those skilled in the art, several modifications and improvements can be made without departing from the concept of the present application, which are within the protection scope of the present application. Therefore, the protection scope of the present application should be based on the attached claims.

What is claimed is:

1. A fast adjustable dumbbell, comprising:

a handle, provided with a first accommodation cavity;

a plurality of dumbbell pieces, the dumbbell pieces are divided into two groups, and the two groups of dumbbell pieces are respectively provided on outer sides of two ends of the handle, and each of the dumbbell pieces is provided with a first through hole;

a rotatable shaft, comprising two independent half shafts, the two half shafts are provided in the first accommodation cavity, and the two half shafts are capable of being moved relative to the handle; outer surfaces of the two half shafts are provided with symmetrical first threads, and positions of the two half shafts are aligned with the first through holes;

two transmission components, which are respectively fixed at the two ends of the handle, and the two transmission components are provided with second through holes corresponding to a position of the first accommodation cavity; hole walls of the second through holes are provided with second threads that are engaged with the half shafts;

when the handle is rotated, the two transmission components are driven to rotate, and the two half shafts that are engaged with the transmission components are compressed and extended from the second through holes to pass through the first through holes of the dumbbell pieces when the transmission components are rotated;

wherein the handle comprises a handheld part and a fixing part, there are two fixing parts, and the two fixing parts are respectively provided at two ends of the handheld part;

the dumbbell further comprises two first fixing members, which are respectively fixed with the fixing part and the transmission components;

wherein the fixing part is provided with a first positioning hole;

each of the two first fixing members comprises a first positioning part and a second positioning part, wherein each of the two first fixing members is sleeved on the fixing part and the first positioning part is clamped into the first positioning hole;

each of the two transmission components is provided with a second positioning hole, and each of the two transmission components is provided at one side of one first fixing member away from the handheld part, and the second positioning part is clamped into the second positioning hole.

2. The fast adjustable dumbbell according to claim 1, wherein the dumbbell further comprises a fixed shaft, and a second accommodation cavity is formed in the rotatable shaft configured for setting the fixed shaft.

3. The fast adjustable dumbbell according to claim 2, wherein the dumbbell comprises a base, a second fixing member, and a pin, the handle further comprises a sliding part, which is provided between the fixing part and the handheld part;

the base is provided on the sliding part;

the second fixing member is provided on one side of one transmission component away from one first fixing member, and is fixed to the base at an outside of one transmission component to clamp the transmission component between the base and the second fixing member; the second fixing member is provided with an insertion hole;

one end of the fixed shaft is exposed from the first accommodation cavity and is provided with a slot, the slot is aligned with the insertion hole;

the pin is inserted into the insertion hole and the slot so as to fix the fixed shaft to the second fixing member.

4. The fast adjustable dumbbell according to claim 3, wherein the dumbbell further comprises a bearing and a nut, and the handle further comprises a rotatable part located between the sliding part and the fixing part, the bearing is sleeved on the sliding part, and the base is sleeved on the bearing;

an outer surface of the rotatable part is provided with a third thread, and a screw hole of the nut is provided with a fourth thread, the nut is threaded connection to the rotatable part, so that the handle is capable of being rotated relative to the nut.

5. The fast adjustable dumbbell according to claim 3, wherein the dumbbell further comprises a weight scale ring, and the handle further comprises a clamping part, the clamping part is located between the sliding part and the handheld part, and an outer surface of the clamping part is provided with a first notch;

an inner wall of the weight scale ring is provided with a second notch, and the weight scale ring is sleeved on the clamping part; the first notch is clamped to the second notch, so that the weight scale ring and the handle are fixed;

the base is protruded outwardly from one side of the handheld part to form a sleeve ring, and the weight scale ring is embedded in the sleeve ring; the sleeve ring is provided with a display window to display scale values on the weight scale ring.

6. The fast adjustable dumbbell according to claim 5, wherein a plurality of third accommodation cavities are provided on one side of the base facing the transmission components along a circumferential direction of the base, and each of the third accommodation cavities is provided with a first elastic member and a rolling member;

one side of each one transmission component that is facing the base is provided with a plurality of rolling holes along the circumferential direction;

when the transmission components are rotated to be aligned with the rolling holes and the rolling member, the rolling member is popped out towards the rolling holes under an action of the first elastic member, and at other positions of the transmission components, the rolling member is rolled on one side of the transmission component.

7. The fast adjustable dumbbell according to claim 3, wherein the dumbbell further comprises a fixed seat, a locking member, and a second elastic member, the fixed seat is configured to place the dumbbell pieces and the handle, and the fixed seat is provided with a protruding lifting piece;

each of the two transmission components is provided with a plurality of spaced protrusions along the circumferential direction;

the base is provided with a fourth accommodation cavity at a position of an outer side of a corresponding transmission component; the fixing part is provided on one side of the fourth accommodation cavity close to the corresponding transmission component;

the second elastic member is provided in the second accommodation cavity, and one end of the second elastic member is fixed to the fixing part and the other end thereof is fixed to the locking member;

the locking member comprises a locking part and a connection part; the connection part is provided in the fourth accommodation cavity and fixed to the other end of the second elastic member; the locking part is extended from the fourth accommodation cavity and comprises a locking mouth; the protrusions are located in the locking mouth;

when the lifting member lifts the connection part, the second elastic member is compressed, and the locking part is driven to lift up; the protrusions are arranged spaced apart on two sides of the locking mouth;

when the handle is lifted, the second elastic member restores its elasticity, and the connection part pulls the locking member downwards by an elastic force, so that an upper side of the locking mouth presses the protrusions.

8. The fast adjustable dumbbell according to claim 1, wherein each dumbbell piece is provided with one protrusion and one recess on two sides of the dumbbell piece, and protrusions and recesses between adjacent dumbbell pieces are clamped with each other to fix the dumbbell pieces.

* * * * *